US006253701B1

(12) United States Patent
Dale

(10) Patent No.: US 6,253,701 B1
(45) Date of Patent: Jul. 3, 2001

(54) ANCHORING DEVICE

(75) Inventor: Olav Dale, Åkersberga (SE)

(73) Assignee: Roslagens Maricenter AB, Akersberga (SE)

( * ) Notice: Subject to any disclaimer, the term of this patent is extended or adjusted under 35 U.S.C. 154(b) by 0 days.

(21) Appl. No.: 09/380,281

(22) PCT Filed: Feb. 27, 1998

(86) PCT No.: PCT/SE98/00357

§ 371 Date: Aug. 27, 1999

§ 102(e) Date: Aug. 27, 1999

(87) PCT Pub. No.: WO98/38079

PCT Pub. Date: Sep. 3, 1998

(30) Foreign Application Priority Data

Feb. 27, 1997 (SE) ..... 9700710

(51) Int. Cl.[7] ..... B63B 21/34
(52) U.S. Cl. ..... 114/301; 114/294
(58) Field of Search ..... 114/301, 294, 114/295, 299

(56) References Cited

U.S. PATENT DOCUMENTS

| | | | | |
|---|---|---|---|---|
| 2,468,077 | * | 4/1949 | Kellum | 114/299 |
| 3,180,304 | | 4/1965 | Brady . | |
| 3,417,724 | * | 12/1968 | Edwards | 114/295 |
| 3,516,379 | | 6/1970 | Skoog . | |
| 3,908,575 | * | 9/1975 | Giolfo . | |

FOREIGN PATENT DOCUMENTS

| | | | | |
|---|---|---|---|---|
| 2929495 | * | 2/1981 | (DE) | 114/301 |
| 1509524 | * | 5/1978 | (GB) | 114/301 |
| 2 227 988 | * | 8/1990 | (GB) . | |

OTHER PUBLICATIONS

Japan abstract vol. 7, No. M–256, abstract of Japan JP 58–139889 (Goyou Kensetsu K. K.), Aug. 19, 1983.

* cited by examiner

*Primary Examiner*—Sherman Basinger
(74) *Attorney, Agent, or Firm*—Birch, Stewart, Kolasch & Birch, LLP

(57) ABSTRACT

An anchoring device includes a cylindrical hollow body having a first edge, a second edge and an attachment device for applying a chain or wire to the body. At least one fluke device is arranged at the end of the body opposite to the attachment device.

19 Claims, 2 Drawing Sheets

ANCHORING DEVICE

BACKGROUND OF THE INVENTION

1. Field of the Invention

The present invention concerns an anchoring device including a cylindrical hollow body having a first edge, a second edge, a forward end having attachment means for applying a traction force to the body, a backward end opposite to the forward end, and fluke means for improved anchorage properties.

The term cylindrical body used herein is intended to include any kind of cylindrical body, i.e., not only a straight circular cylinder body, but also such cylinders that have a non-regular figure as its base, or an axis that is not perpendicular to the base.

The anchoring device is primarily, but not exclusively, intended for permanent or long-time anchorage, such as for anchoring oil rigs.

2. Description of Background Art

A plurality of different anchoring devices are known since long ago for anchoring ships and smaller vessels, such as yachts, as well as for anchoring mooring buoys and floating platforms, such as oil rigs. When it comes to anchoring floating landing stages or jetties, heavy and cumbersome molded concrete blocks are frequently used having a steel eye molded into the block for attachment of an anchor chain or wire. Since a solid body of concrete, having a specific gravity of 1.8–2.5 depending, a.o., on the ballast material, looses about 40% of its effective weight when it is immersed in water, it must be made excessively big and heavy in order to achieve its desired anchorage properties, or, it must be shaped such that its shape provides improved anchorage properties.

An anchoring device made of steel, having a specific gravity of typically 7.8, can be made much smaller for a certain weight, and it can easily be shaped for improved anchorage properties, such as being provided with sheet metal projections as fluke means. One such anchoring device having a cylindrical body in the shape of a straight circular cylinder is marketed in Sweden under the trade name "P-ringen" (the P-ring). It consists of a circularly bent length of strip iron, the ends of which are welded together to form a closed ring. A steel eye is welded to the outer circumference of the ring for attachment of a chain or wire. Symmetrically about the eye, four flukes are welded to the ring, two at one axial end of the cylinder and two at the opposite axial end thereof. The flukes are slightly bent so as to be directed towards the direction of traction in a chain or wire attached to the eye. This is supposed to improve the anchorage by making the forward end of the device dig into the bottom.

A problem encountered, however, is that heavy sea, combined with heavy traction in the chain or wire, tends to raise the forward end of the ring with the flukes from the bottom, thus leaving only the back end of the ring in bottom contact.

SUMMARY OF THE INVENTION

It is an object of the present invention, thus, to provide an improved anchoring device including a cylindrical body having attachment means for applying traction force to the body. This is simply achieved by providing at least one fluke means arranged at the backward end of the body.

With the above construction the fluke means never looses contact with the bottom even when heavy forces raise the forward end of the device. On the contrary, on soft bottoms, such as clay, mud and sand, repeated raising and lowering of the forward has been found to cause the backward end to cut even deeper into the bottom than a mere pulling force at the forward end, even if the fluke means is directed in an axial direction of a straight cylinder.

In order to further improve the capability of cutting or sinking into a relatively soft bottom, vibrator means may be utilized to vibrate the anchoring device. Such vibrator means may be integrated in the device, or, preferably, be temporarily connected thereto by being lowered along the anchor chain or wire until it contacts the anchoring device.

In one embodiment of the present invention, the anchoring device includes means for shifting the effective point of action of the anchor chain or wire to a position at the backward end in order to facilitate heaving of the device from the bottom.

It should be emphasized that the arrangement of fluke means at the backward end does not exclude fluke means arranged at the forward end of the body as well.

An anchoring device according to the present invention is preferably made of steel or reinforced concrete. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Embodiments of the present invention will now be described, reference being made to the accompanying drawings, wherein.

DESCRIPTION OF THE PREFERRED EMBODIMENT

Figure 1:
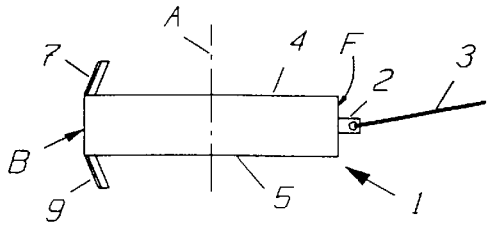
FIG. 1 is a side view of a first embodiment of an anchoring device according to the present invention.
Figure 2:
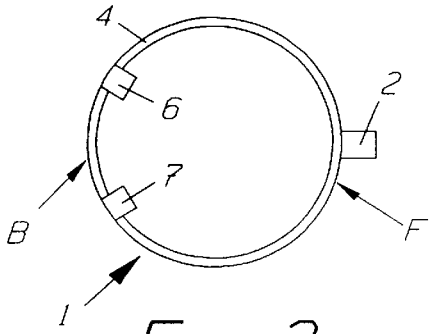
FIG. 2 is a plan view of the device of FIG. 1.
Figure 3:
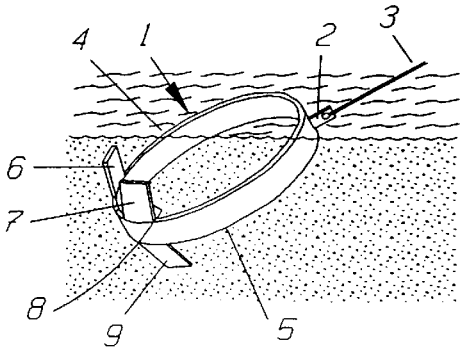
FIG. 3 is a perspective view of the device according to FIGS. 1 and 2 shown in a position partly sunk into the bottom of the sea.

The first embodiment of the present invention shown in FIGS. 1–3 includes a ring-shaped body 1 formed as a straight circular cylinder. It is preferably made from a length of band steel, which is formed into a circle, whereupon the ends of the length are welded together. A steel eye 2 is welded to the outer circumference of the body 1 in a region of the body referred to here as the forward end F of the device, and serves for the attachment of a pulling means such as a chain or wire 3. The body 1 has a first and a second axially opposed and mutually parallel edges, referred to here as upper edge 4 and bottom edge 5. According to the present invention, the body 1 is provided with at least one fluke means in a region opposite to the attachment eye 2. This region is referred to here as the backward end B of the device. In the embodiment of FIGS. 1–3, there are two steel flaps 6 and 7 welded to the upper edge 4 and two steel flaps 8 and 9 welded to the bottom edge 5 at respective positions symmetrically about a position diametrically opposed to the eye 2.

As seen in FIGS. 1 and 3, in order to promote cutting into the bottom B (FIG. 3), the flaps 6–9 are slightly inclined in relation to the axial direction of the circumferential surface of the body 1, such that their extremities are closer to the axis A of the cylindrical body 1 than their inner ends connected to the body 1. However, even flaps extending parallel to the axis perform very well, particularly in cases where the forward end of the device is raised so that its backward end and the flaps incline from the vertical.

Figure 4:
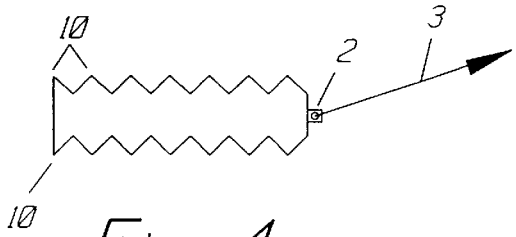
FIG. 4 is a side view of a second embodiment of the device.

The second embodiment of the present invention shown in FIG. 4 exhibits fluke means in the shape of triangular teeth 10 provided along the upper and the bottom edges of the device. As seen, these teeth are not angled in relation to the axis of the device. This embodiment is believed to function well on relatively hard and rocky bottoms.

The embodiments of FIGS. 1–3 and FIG. 4 have fluke means on their upper as well as their bottom edges. This is preferred since it allows dropping of the device without particular care of which edge will be resting on the bottom. However, anchoring devices with fluke means on just one edge will perform just as well as long as it is ensured that the fluke means are facing the bottom in their operative position. This may be achieved by lowering the device in its operative position by special hoisting devices.

For anchoring cases where extreme anchorage forces are involved, the present invention proposes to utilize anchoring devices having oblique cylindrical bodies, viz., such that the cylinder axes incline from the direction of traction in the chain or wire 3.

Figure 5:
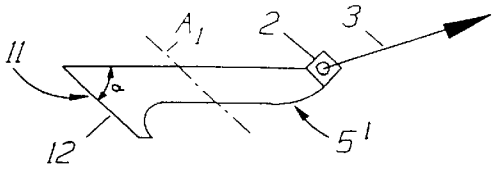
FIG. 5 is a side view of a third embodiment of the device.
Figure 6:
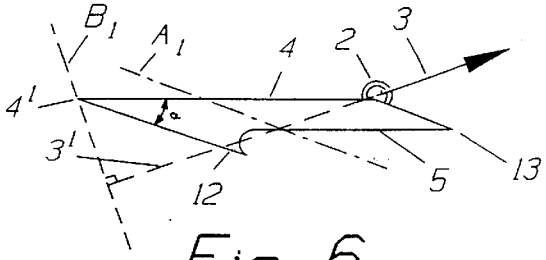
FIG. 6 is a side view of a fourth embodiment of the device.

The third and fourth embodiments of the present invention according to FIGS. 5 and 6, respectively, exhibit such an oblique cylindrical body 11 having inclined respective axes $A_1$. At least one tooth 12 is provided at the bottom edge of the bodies opposite to an eye 2 to project downwards from the bottom edge under a respective angle $\alpha$. The angle $\alpha$ may be any angle between 90° and 10°, preferably between 45° and 10°. The forward end of the bottom edge 5 is rounded at 5' in the embodiment of FIG. 5 in order not to disturb the function of the rear end tooth 12 when the device is used on relatively hard and rocky bottoms, whereas the embodiment of FIG. 6 exhibits a pointed edge 13 at the forward end of the body. This embodiment is useful on sandy and muddy bottoms without larger rocks in order to achieve maximum cutting into the bottom for more permanent anchorage and is particularly intended to be laid down by special anchoring vessels towing the device along the bottom until it has reached as desired depth into the bottom and until a desired towing resistance has been reached.

In the oblique embodiments according to FIGS. 5 and 6, it is preferred to position the attachment eye 2 at the forward end of the upper edge 4 or, even above this edge, as shown in FIG. 5. Due to this location, when lowering the anchoring device, it will be hanging in a position relative to the chain or wire resembling those shown in FIGS. 5 and 6. In FIG. 6, an extension 3' of the chain or wire 3 is drawn with a dashed line and a further dashed line B', representing the bottom B in a position where the device reaches the bottom B is illustrated. Thus, holding FIG. 6 such that the chain or wire 3 extends vertically, it will be seen that the device will land on the backward end or tip 4' of its upper edge 4. Obviously, upon further lowering, the device will tend to fall to the right, i.e., such that it eventually lands on its bottom edge. In order to be absolutely certain that the device also will be oriented such that the chain or wire 3 be directed in the direction intended, it is advisable to lower the device while slowly moving in said direction.

A further benefit of locating the attachment eye in a high position is that rotation or tilting of the device due to pull in the chain or wire 3 is counteracted.

Figure 7:
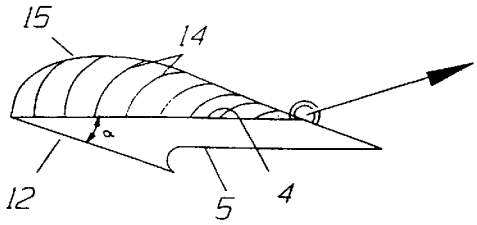
FIG. 7 is a side view of a fifth embodiment of the device.
Figure 8:
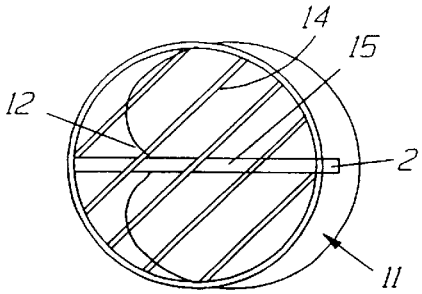
FIG. 8 is a top view of a device according to FIG. 7.

In order to be able to use a device according to FIG. 5 or 6 as a normal anchor that is allowed to drop freely, the present invention provides a fifth embodiment shown in FIGS. 7 and 8 to resemble that of FIG. 6, but provided with a means for rotating the device should it land upside down. This means comprises a plurality of arcuately curved bars 14, the ends of which are attached to the upper edge 4 at respective opposite positions, such that they extend under an acute angle in relation to the direction of pull in the chain of wire 3. A single arcuately curved supporting bar 15 is likewise attached to the upper edge 4 extending centrally over the body in the direction of pull under the bars 14 from a position above the eye 2 to a position opposite thereto. The bars 14 and 15 form a cage-like, convex structure which, due to the orientation of the bars 14 in relation to the direction of pull, will cause rotation of the body should it come to rest upside down, and provided a pulling force is applied to the chain or wire 3.

Figure 9:
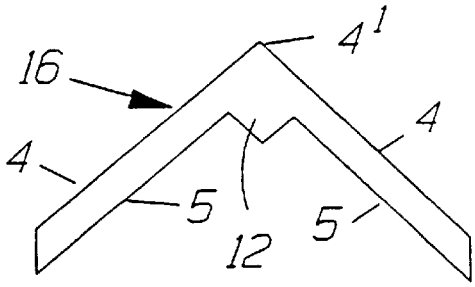
FIG. 9 is a plan view of a blank for manufacturing a device according to FIG. 6.

FIG. 9 shows a plan view of a blank 16 for the manufacture of an anchoring device substantially as that according to FIG. 6.

Figure 10:
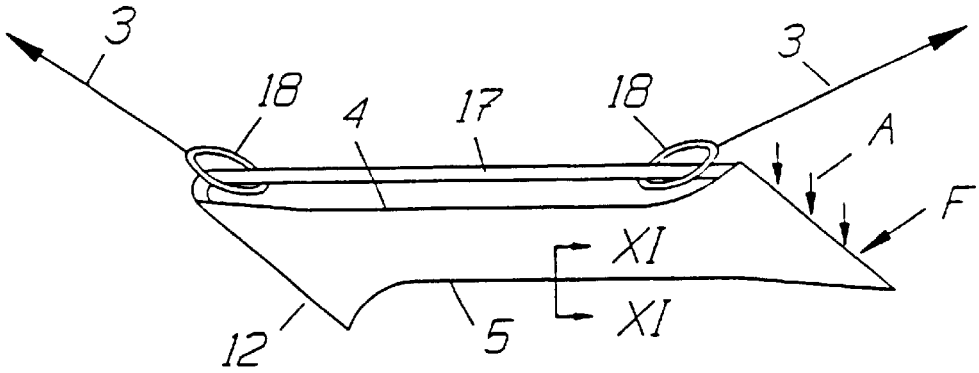
FIG. 10 is a side view of a sixth embodiment of the device.
Figure 13:
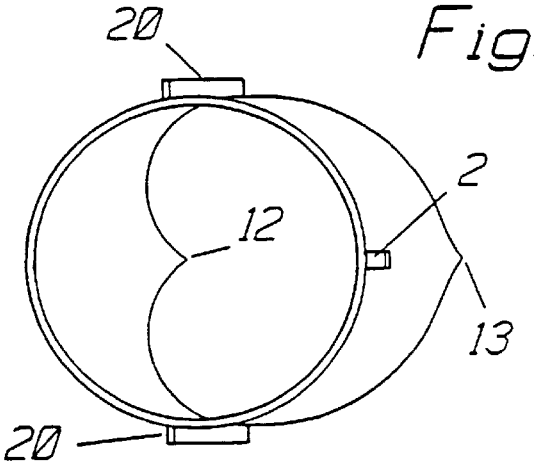
FIG. 13 is a top view of the device according to FIG. 12.

The sixth embodiment of the present invention shown in FIG. 10 is provided with a means for shifting the direction of pull in the anchor chain or wire 3. This means comprises a straight bar 17 extending over the body 11 and attached to the forward and backward ends of the body such that an attachment means in the shape of a ring 18 is free to slide therealong from the forward to the backward end. Should the need arise to heave the anchoring device, the direction of pull is shifted from that shown to the right in FIG. 10 to that shown to the left, so that the pulling force be directed along the axis of the body.

FIG. 10 also shows that the forward end of the body has been given an increased area by the upper edge 4 being somewhat raised and the bottom edge 5 being somewhat lowered in relation to their respective main portions. This results in an increased influence by the masses acting against the forward end as indicated by arrows A.

Figure 11:
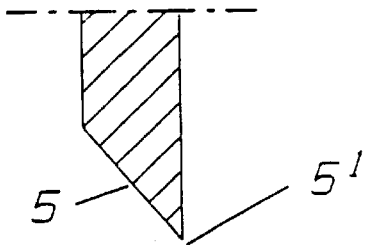
FIG. 11 is a section at an enlarged scale along line X—X of FIG. 10.

The section according to FIG. 11 shows that the bottom edge 5 may be provided with a sharp tip 5' to improve the penetrating properties of the edge into the bottom.

Figure 12:
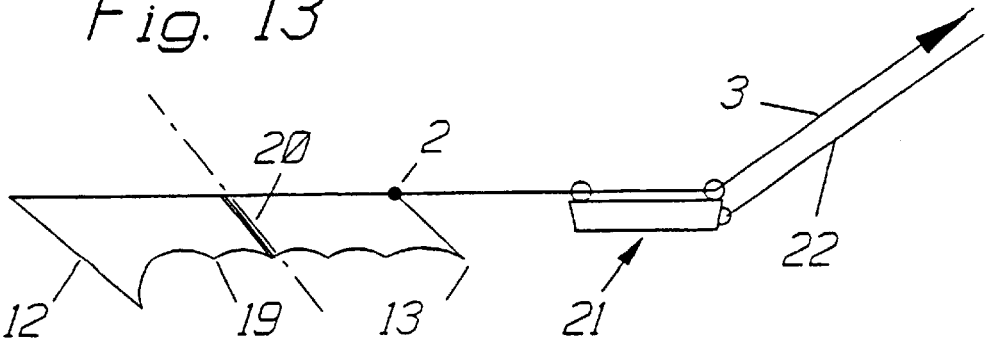
FIG. 12 is a side view of a seventh embodiment of the device, also showing a vibrator means.

In the seventh embodiment according to FIG. 12, apart from a backward tooth 12 and a forward tip 13, the body is provided with a wave-shaped bottom edge having a plurality of relatively sharp tips 19. Furthermore, plate-shaped blades or fins 20 are attached to the sides of the body in opposite positions between the forward and backward ends and directed parallel to the axis of the body so as to contribute to cutting the anchoring device into the bottom.

Furthermore, FIG. 12 shows a device 21 being slidingly mounted on the chain or wire 3 and being provided with a wire 22 or the like, by means of which the device may be lowered along the chain or wire 3. The device 21 may be just a weight to affect the direction of pull towards a more horizontal direction as shown, or, it may be a vibrator that is operated by a driving medium, such as electricity or pressurized air or oil supplied through the wire 22 or a separate supply means. In the vibrator case, the device is moved into contact with the body 11, such that vibrations of the device are transmitted to the body, thus promoting its sinking into the bottom. A vibrator device may alternatively be incorporated in the body 11. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An anchoring device, comprising:

a cylindrical hollow body having a cylinder axis, a first, upper edge, a second, lower edge adapted to face the seabed when the device is lowered to rest thereon, a forward end having attachment means for applying a traction force to said body, a backward end opposite to said forward end, and fluke means for improved anchorage properties, wherein at least one fluke means is arranged at said backward end of said body.

2. The anchoring device according to claim 1, wherein said body is a straight circular cylinder.

3. The anchoring device according to claim 2, wherein at least one fluke means is arranged at each of said upper and lower edges at said backward end of said body.

4. The anchoring device according to claim 1, wherein said body is an oblique cylinder.

5. The anchoring device according to claim 4, wherein a fluke means is arranged at said forward end of said body.

6. The anchoring device according to claim 4, wherein said attachment means is located at or above said upper edge.

7. The anchoring device according to claim 4, wherein plate-shaped fins are provided projecting from an outer circumference of said body at opposite positions thereof located between said forward end and said backward end, said fins having planes inclined in correspondence to an inclination of said cylinder axis.

8. The anchoring device according to claim 4, wherein said fluke means includes at least one tooth projecting downwardly from said lower edge at an angle from said upper edge between 90° and 10°.

9. The anchoring device according to claim 8, wherein said angle is between 45° and 10°.

10. The anchoring device according to claim 4, wherein the traction force is applied in a first direction, and said cylinder axis is inclined relative to the seabed and said first direction during application of the traction force.

11. An anchoring device comprising:

a hollow body having an outer wall defining a first upper edge, a second lower edge, a forward edge and a rear edge, said rear edge being displaced a predetermined distance from said forward edge and said rear edge being disposed to be substantially opposite to the positioning of the forward edge of said hollow body;

attachment means being secured to said forward edge of said hollow body for applying a traction force thereto;

at least one fluke being secured to said rear edge, said at least one fluke projecting below the lower edge of said hollow body;

a fluke means arranged at said forward edge of said body; and an opening extending through a hollow space defined by said outer wall whereby a traction force applied to said attachment means displaces said hollow body in a first direction wherein said opening is not oriented to be aligned with said first direction.

12. The anchoring device according to claim 11, wherein said body is a straight circular cylinder.

13. The anchoring device according to claim 12, wherein at least one fluke means is arranged at each of said upper and lower edges at said rear edge of said body.

14. The anchoring device according to claim 11, wherein said body is an oblique cylinder.

15. The anchoring device according to claim 14, wherein said attachment means is located at or above said upper edge.

16. The anchoring device according to claim 14, wherein plate-shaped fins are provided projecting from an outer circumference of said body at opposite positions thereof located between said forward edge and said backward edge, said fins having planes inclined in correspondence to an inclination of said cylinder axis.

17. The anchoring device according to claim 14, wherein said at least one fluke projects at an angle from said upper edge between 90° and 10°.

18. The anchoring device according to claim 17, wherein said angle is between 45° and 10°.

19. The anchoring device according to claim 14, wherein an axis of said hollow body is inclined relative to the seabed and a pulling direction of the traction force during application of the traction force.

* * * * *

UNITED STATES PATENT AND TRADEMARK OFFICE

CERTIFICATE OF CORRECTION

PATENT NO. : 6,253,701 B1
DATED : July 3, 2001
INVENTOR(S) : Olav Dale

It is certified that error appears in the above-identified patent and that said Letters Patent is hereby corrected as shown below:

Title page,
Item [73] Assignee, please correct the assignee's name from "Roslagens Maricenter AB" to -- Roslagens Marincenter AB --.

Signed and Sealed this

Fifth Day of March, 2002

*Attest:*

*Attesting Officer*

JAMES E. ROGAN
*Director of the United States Patent and Trademark Office*